United States Patent [19]

Conklin, Jr.

[11] 4,055,038

[45] Oct. 25, 1977

[54] APPARATUS FOR WRAPPING STRINGS FOR MUSICAL INSTRUMENTS

[75] Inventor: Harold A. Conklin, Jr., Cincinnati, Ohio

[73] Assignee: D. H. Baldwin Company, Cincinnati, Ohio

[21] Appl. No.: 662,610

[22] Filed: Mar. 1, 1976

[51] Int. Cl.[2] ..... B65H 81/06; G10D 3/10

[52] U.S. Cl. ..... 57/11; 84/297 S; 242/7.01

[58] Field of Search ..... 57/10, 11, 6, 160, 18, 57/19; 84/297 S; 242/7.01

[56] References Cited

U.S. PATENT DOCUMENTS

| | | | |
|---|---|---|---|
| 584,708 | 6/1897 | Schaff | 57/11 |
| 635,039 | 10/1899 | Emerson | 57/11 |
| 1,102,233 | 7/1914 | Biava | 57/11 |
| 2,334,880 | 11/1943 | Marlow | 57/6 X |
| 2,342,342 | 2/1944 | Hotchkiss, Jr. et al. | 57/11 |
| 3,035,395 | 5/1962 | Bohannon, Jr. | 57/19 |
| 3,368,268 | 2/1968 | Sherman | 57/11 X |
| 3,381,459 | 5/1968 | Vawter | 57/18 |
| 3,391,874 | 7/1968 | Vinciguerra | 242/7.01 |
| 3,990,220 | 11/1976 | Chaffee | 57/11 |

*Primary Examiner*—John Petrakes

*Attorney, Agent, or Firm*—Melville, Strasser, Foster & Hoffman

[57] ABSTRACT

An apparatus for wrapping strings for musical instruments in which the various parameters influencing the quality of the string are accurately controlled, the apparatus comprising an elongated track mounting an opposing pair of heads having rotatable shafts to which the opposite ends of a core wire are fastened, the shafts being rotated in unison by a pair of electronically controlled stepping motors, means being provided to tension the core wire between the heads, the wrapping wire being fed into contact with the core wire by a vertically disposed feed arm suspended from an overhead carriage traveling lengthwise of the track member, the wrapping wire being fed to the feed arm from a source of supply and, as an incident of such feeding, a predetermined tension is applied to the wrapping wire, the feed arm including means for controlling the rate at which the feed arm advances and means for controlling the angle between the wrapping wire and the core wire, the track member also mounting adjustable anvils for forming flats at the opposite ends of the portion of the core wire being wrapped, together with indicia for accurately positioning the operating components of the apparatus relative to the core wire being wrapped.

37 Claims, 6 Drawing Figures

APPARATUS FOR WRAPPING STRINGS FOR MUSICAL INSTRUMENTS

This invention relates to apparatus for wrapping strings for musical instruments, and while the invention will be described in connection with the manufacture of wrapped piano strings, it is to be understood from the outset that the apparatus may be utilized to manufacture wrapped strings for other types of musical instruments which embody wrapped strings.

In the manufacture of pianos, "loaded" or "wrapped" strings normally are used in the bass section of the instrument. Such wrapped strings normally comprise a steel core wire and a helically wound covering wire, usually copper wire, wrapped around substantially all of that portion of the length of the core wire which comprises the so-called speaking length of the string, the speaking or vibrating length being that portion of the string which in a conventional grand piano begins at an agraffe or string-deflecting element near the front of the instrument and extends rearwardly to another string-deflecting element located on the soundboard bridge. The purpose of the wrapping is to add uniformly distributed mass to the vibrating length of the longer strings so that when all of the strings of the piano are tuned to their normal operating frequencies, the tension of the bass strings will be sufficient to provide the necessary output for the instrument when it is played.

BACKGROUND OF THE INVENTION

The presently available equipment for making wrapped strings is basically quite old and has not changed materially over the years other than in minor refinements. Essentially, the equipment has a lathe-like configuration with two heads, at least one of which can be moved along the length of the machine to accommodate strings of varying length. Each head is provided with a fastening device, such as a hook, chuck, or other means to grip one end of the core wire. Each hook is arranged to rotate about its own central axis in a direction such that the core wire, when mounted on the hooks, will also rotate about its own lengthwise axis during the wrapping operation. Both hooks must rotate in phase at exactly the same number of revolutions per unit of time in order to avoid torsional twisting of the core wire. The hooks are normally driven by system of shafts and gears connected to a single drive motor. A force is provided, sometimes fixed, sometimes variable, for stretching the core wire in tension during the wrapping operation. Actuating means are provided for starting and stopping the rotation of the core wire, such actuating means usually being under the control of the machine operator. Means are also provided to flatten the core wire for a short distance at each end of the portion of the wire which is to receive the wrapping so that the ends of the wrapping wire may be anchored to the core wire, usually by swaging against the flattened portions of the wire so that the ends of the wrapping wire cannot turn relative to the core wire.

Historically, the application of the wrapping wire to the core wire has been done manually by the machine operator, usually by withdrawing the wrapping wire from a spool located near the machine and wrapping the free end around one of the flattened portions of the core wire, including the breaking-off of the leftover end of the wrapping wire, whereupon the machine is started to rotate the core wire. The operator feeds the wrapping wire onto the core wire by hand, the operator providing the necessary restraining tension on the wrapping wire and also maintaining the required angle between the axes of the core and wrapping wire during the wrapping operation. As the wrapping wire approaches its end point, the operator turns off the machine so as to brake it to a stop when the wrapping wire reaches the end of the other flattened portion of the core wire. As can be appreciated, such machines require a considerable amount of operator training and experience in order to produce usable strings, it being necessary for the operator to judge the correct pull and angle of the wrapping wire in order to produce a uniform and correct winding, and it is also necessary to judge when to turn-off the machine in order that the last turn of the wrapping wire will coincide with the end of the flattened portion of the core wire. With machines of this type, the production of strings of consistent musical quality is essentially an art depending upon the skill of a particular machine operator; and while the techniques of machine operation can be passed from operator to operator, there has been no known set of standards by which strings of consistent quality can be made by different operators, or even by the same operator at different times.

While various refinements have been added to the machines over the years to mechanically control portions of the winding operation, the machines are still basically manually controlled by the operator and subject to numerous variables and human error. For example, the wrapping wire supply spool has been mounted for movement along the length of the machine as the winding operation progresses, the spool being mounted on a carrier having a lead screw arrangement for moving the carriage in timed relation to the rotation of the core wire. An adjustment for wrapping wire tension is also provided on some machines, as by means of a friction-type brake which engages the wrapping wire. Variation in tension is achieved by tightening a set screw which increases or decreases the frictional drag exerted by the brake on the wrapping wire. Suffice to say, however, that such refinements are in themselves relatively crude and do not take into account many of the parameters which have been found essential to produce wrapped strings of uniformly high quality.

In contrast to the prior art equipment characterized above, the present invention provides a unique string wrapping machine which is essentially automatic in operation and effectively free from human error so that strings of uniformly high and consistent quality may be reliably produced.

SUMMARY OF THE INVENTION

In accordance with the present invention an apparatus is provided which will accurately control throughout a wide range of operating conditions the various factors which have been found to influence the quality of the wrapped string. The factors involved may be enumerated as follows:

1. Tension or pull of the core wire during wrapping of the string.
2. Rotational speed (r.p.m.) of the core wire during wrapping.
3. Tension or pull of the wrapping wire.
4. The angle formed by the wrapping wire relative to the core wire during wrapping.
5. The number of turns of wrapping wire on the core wire.

6. The precise diameter of the finished string.
7. Vibration of the core and wrapping wires during the wrapping operation.

The apparatus in accordance with the present invention provides for a wide range of variation in the parameters noted above and the ability to maintain a constant relation between these parameters during the wrapping operation. In addition, provision is made to minimize the vibration of the string during the wrapping operation.

In accordance with the invention, the apparatus comprises a supporting frame mounting an elongated I-beam or track member on which a number of the operating components are mounted. A fixed head is fixedly mounted on the track adjacent one end thereof, the fixed head mounting a motor and associated loop hook or chuck for receiving one end of the core wire to be wrapped. The fixed head also mounts an electronic pickup which provides an electric signal for each revolution of the motor shaft. A second head is adjustably mounted on the track toward its opposite end, the second head mounting an identical motor with associated shaft and hook or chuck for attaching the opposite end of the core wire. The second head is mounted on a movable carriage so that its position can be adjusted along the track to accommodate core wires of differing lengths. Tension or pull on the core wire is obtained by means of a pneumatic cylinder operatively connected to the carriage and arranged to effect relative movement between the carriage and an adjustable stop locked to the track. An air pressure adjusting regulator and gauge are associated with the pneumatic cylinder to accurately maintain the core wire under the desired tension. The motors which rotate the core wire are stepping motors which are driven in exact synchronism, and consequently their drive shafts will rotate through identical angles so that the core wire will not be twisted as it is rotated. Such motors have relatively low internal inertia and can be started and stopped almost instantaneously. These motors are preferably used in conjunction with an electronic counter which may be pre-set to stop the motors after any desired number of turns. With such arrangement, the core wire being wrapped may be placed under the exact tension desired and can be wrapped with exactly the desired number of convolutions of wrapping wire. Alternatively, switch means may be provided to stop the motors after the desired length of core wire has been wrapped.

A spool of wrapping wire is mounted on a spindle preferably located at one end of the track, the spindle being provided with braking means to permit proper feeding of the wrapping wire and also preventing the wire from spilling off the supply spool. Such braking means does not, however, determine the amount of tension on the wrapping wire as it is being wrapped; rather, wrapping wire tension is controlled by a swing arm or "dancer arm" mounting a pulley about which the wrapping wire passes upon being withdrawn from the supply spool by means of a variable speed feed motor. The exact tension desired is obtained by adding weights to the dancer arm which pulls on the wrapping wire in accordance with its effective weight. In addition, the dancer arm is utilized to control the speed of the feed motor in accordance with the quantity of wrapping wire required to wrap a given core wire. This portion of the apparatus provides accurate and uniform control of the tension of the wrapping wire.

From the supply spool - feed motor - swing arm system, the wrapping wire is fed to a feed arm mounted for movement lengthwise of the track, the feed arm being suspended from a carriage mounted on an overhead conveyor extending lengthwise of the underlying track. Drive means are provided for the feed arm carriage which is driven at the speed corresponding to the growing length of the wrapped portion of the string. At its lowermost end the feed arm mounts a saddle having a V-groove which seats on the core wire a short distance ahead of the point at which the wrapping wire is being applied, the feed arm and saddle serving to restrain the core wire so that it is not deflected from its straight line axis by the pull of the wrapping wire during the wrapping operation. The angle of the wrapping wire relative to the core wire may be adjusted as desired, and means are provided to maintain the desired angle by sensing variations in the angle of the wrapping wire and automatically effecting corrective movement by speeding-up or slowing-down the rate of travel of the feed arm as it travels lengthwise along the core wire. In addition to accurately controlling the angle formed by the wrapping wire relative to the core wire, the contact of the feed arm saddle with the core wire provides a movable nodal point acting to eliminate vibration at the point of wrapping, the elimination of vibration serving to insure uniform diameter of the finished string. In addition, vibration damping materials are employed adjacent the opposite ends of the core wire to further limit string vibration. The device is also provided with means for damping undesirable oscillations of the feed arm.

The apparatus of the present invention makes it possible to control within narrow limits all of the important parameters involved in the string-making art which influence the quality of the resulting string. The apparatus may be set to the wrapping parameters optimum for a particular string, whereupon as many such strings as described can be made and each will have identical properties within extremely small tolerances. The outside diameter of finished strings made by the subject apparatus generally have been found to vary less than 0.01 mm. from one end of a string to another. The number of turns of wrapping on a string, which may contain 4000 or more turns, can be held constant to within 0.1% or less. The apparatus also closely controls the weight of the finished string through precise control of the tensioning of core nd wrapping wires, feed angle, and machine speed, as well as the number of turns of wrapping wire on the string. These factors are important for several reasons. The ability to make identical strings improves the tuning and tonal characteristics of those notes using two or more wrapped strings; in addition, when it is necessary to replace a broken string, the manufacturer can provide an exact replacement. Accurate control of string properties also makes it possible to take maximum advantage of the techniques for tuning the longitudinal mode of stringed instruments, as taught in U.S. Pat. No. 3,523,480. In accordance with this patent, the string are tuned both for flexural modes of string vibrations and for longitudinal modes of string vibrations, the strings being designed so that the frequencies of the fundamental longitudinal modes will bear a specific relationship to the frequencies of the fundamental flexural modes of string vibration. As pointed out in this patent, string weight is important in determining the tuning of the longitudinal mode, and wrapping techniques affect the weight per unit length of the finished string. The present invention provides for extremely accurate weight control and hence implements precise tuning of the strings in accordance with the said patent.

DESCRIPTION OF THE DRAWINGS

FIG. 2 is a fragmentary plan view taken along the line 2—2 of FIG. 1.

DESCRIPTION OF THE PREFERRED EMBODIMENT

Figure 1:
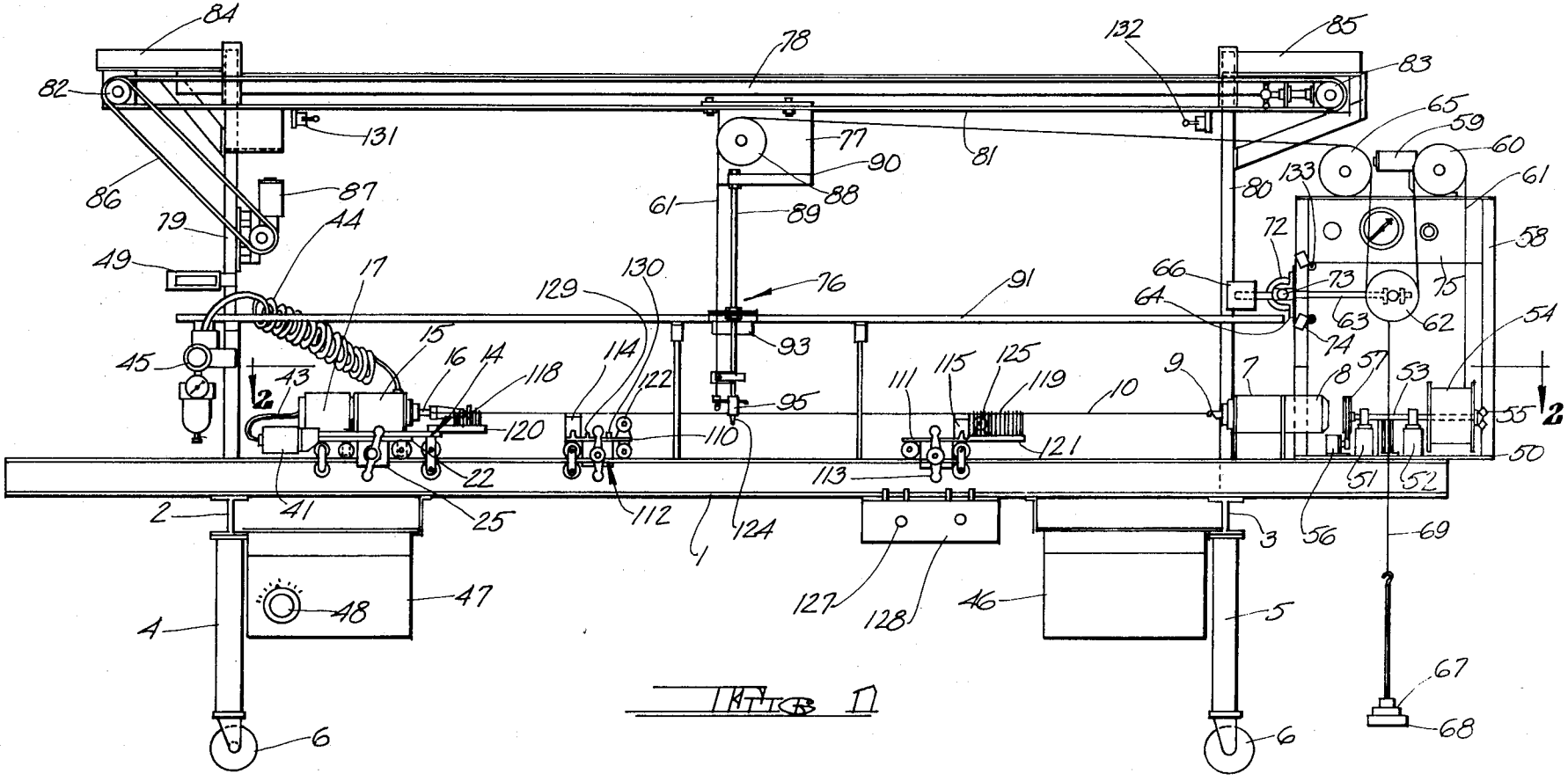
FIG. 1 is a side elevational view of string wrapping apparatus in accordance with the present invention.

Referring first to FIG. 1 which illustrates the over-all organization of the apparatus, the machine frame consists of a main I-beam or track member 1 extending the full length of the apparatus, the main beam being supported near each end by transverse beams 2 and 3 which, in turn, are supported by four legs, two of which are indicated at 4 and 5. If desired, the legs may be provided at their lower ends with casters 6 to permit the apparatus to be readily moved. The exact nature of the frame is not important to the invention, other than for the provision of an elongated rigid track forming member, but the I-beam configuration has been found to be both efficient and economical.

A fixed head 7 is mounted on the main I-beam 1 adjacent the right-hand end of the machine, the head mounting a drive motor 8 for the loop hook 9 to which one end of the core wire 10 is attached in conventional fashion, the loop hook extending through the head 7 and coupled directly to the drive shaft 11 of motor 8, as best seen in FIG. 2. As also seen in FIG. 2, the drive shaft 11 mounts a pulsing vane 12 for an electronic pickup 13 which provides an electric pulse for each revolution of the drive shaft 11.

A movable carriage, indicated generally at 14, is mounted on the track member 1 adjacent its opposite end, the carriage mounting a head 15 in which a core wire receiving chuck 16 is rotatably mounted, the chuck being driven by drive motor 17 mounted on head 15. The opposite end of the core wire 10 is engaged by the chuck 16, which is in axial alignment with the loop hook 9, the core wire 10 thus extending between the heads 7 and 15 and overlying the track member 1. It will be understood that either loop hooks or chucks may be employed at either or both ends of the core wire.

Figure 4A:
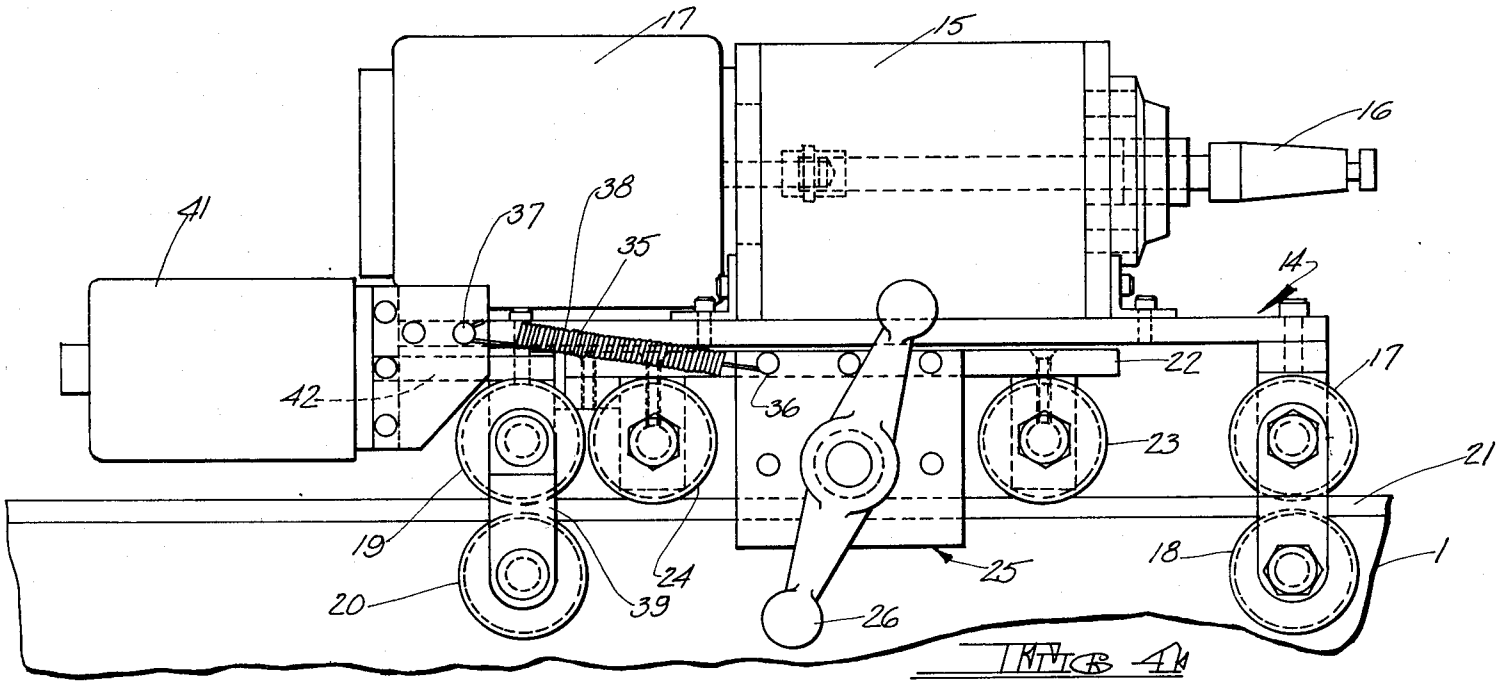
FIG. 4 is a view similar to FIG. 3 but illustrating the carriage in the string engaging and string release position.
Figure 4B:
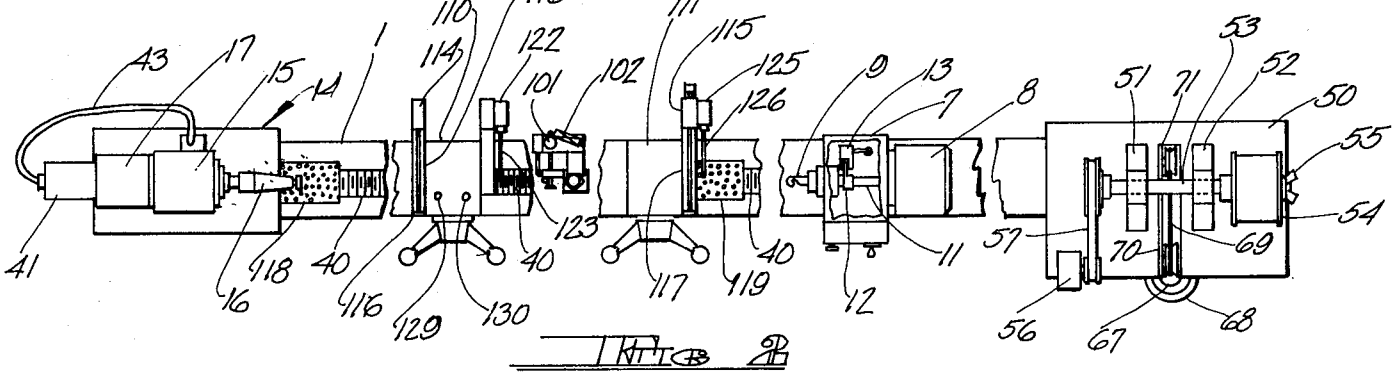
Figure 5:
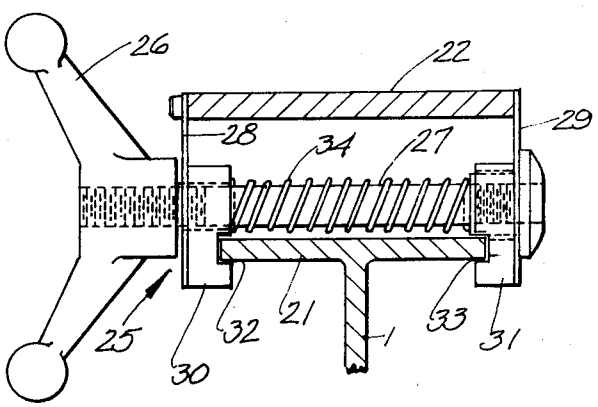
FIG. 5 is a vertical sectional view taken along the line 5—5 of FIG. 3.

The carriage 14, which is movable along the track member 1 to accommodate core wires of differing lengths, is shown in greater detail in FIG. 4, the carriage having sets of opposing flanged wheels at its opposite ends, two such sets being indicated at 17, 18 and 19, 20, which engage opposite sides of the upper flange 21 of the track member 1. Mounted beneath the carriage 14 is a separate undercarriage 22 having sets of flanged wheels at its opposite ends, two of which are indicated at 23 and 24. The undercarriage is provided with a friction brake, indicated generally at 25, which securely clamps the undercarriage 22 to the flange 21 of track member 1 when the brake handle 26 is tighened. As seen in FIG. 5, the brake handle 26 is threaded on shaft 27 extending between side plates 28 and 29 projecting downwardly from carriage 22. A pair of clamping blocks 30 and 31 are slidably mounted on the shaft 27 immediately to the inside of the side plates 28 and 29, respectively, the clamping blocks having slots 32 and 33 in their inner surfaces positioned to engage the opposite side edges of flange 21. A coil spring 34 surrounds the shaft 27 with its opposite ends in contact with the clamping blocks to normally urge them outwardly. When the handle 26 is tightened, the clamping blocks 30 and 31 will be urged into non-slipping engagement with the opposite side edges of the flange 21, thereby fixedly securing the undercarriage to the track member 1. When the handle is loosened, the spring 34 will urge the clamping blocks outwardly to release the undercarriage for movement along the track member 1.

The carriage 14 is connected to the undercarriage 22 by coil springs, one of which is shown at 35 in FIG. 4, the spring extending between a fastener 36 on the undercarriage and a fastener 37 on the overlying carriage 14. The orientation of the springs serves to draw the carriage 14 forwardly toward the undercarriage 22, the undercarriage 22 having a shock absorbing pad 38 at its rearmost end which abuts against the support 39 for wheels 19 and 20. The carriage 14 is thus biased into contacting relation with the undercarriage and the two carriages are adjustable along the track as a unit. In this connection, the leading end of carriage 14 may be utilized as a locating guide adapted to coact with a calibrated measuring rule 40 (seen in FIG. 2) extending lengthwise along the upper surface of track member 1 by means of which the carriage assembly may be positioned at the desired distance from the fixed head 7 at the opposite end of the track.

Figure 3:
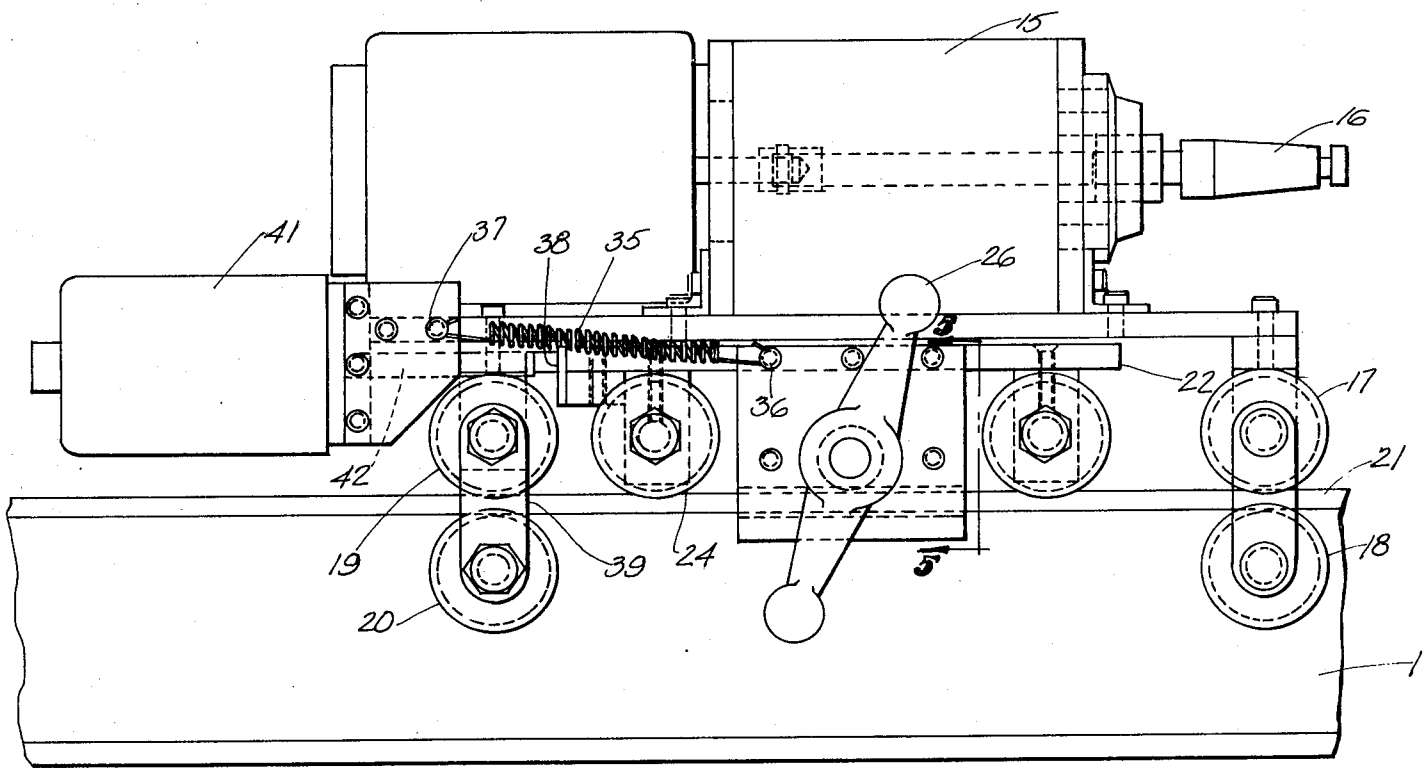
FIG. 3 is an enlarged side elevational view of the string tensioning carriage with the carriage in the tensioned position.

In order to place the core wire 10 under the desired tension or pull, a pneumatic cylinder 41 is mounted on the rear end of the carriage 14, the cylinder having a piston rod 42 the free end edge of which abuts against the rear end of undercarriage 22. Air under pressure is supplied to cylinder 41 through conduit 43 which is connected to an extensible coiled conduit 44 connected to adjustable air pressure regulator 45 mounted on the machine frame. When air under pressure is applied to the cylinder 41, the piston rod 42 will be extended and will bear against the rear end of undercarriage 22, which will be clamped against the track member 1. The piston rod thus serves to move the carriage rearwardly to the position illustrated in FIG. 3, carrying with it the head 15 and chuck 16, the chuck 16 thus exerting a pulling force on the core wire 10. The desired amount of pull of tension is controlled by the adjustable air pressure regulator 45 and may be varied as desired. The pneumatic cylinder 42 is preferably of a type having low internal friction, i.e., the force required to overcome the cylinder friction will be small in comparison with the pull required to tension the core wire, so that the tension of the core wire will be identical from string to string.

When the air pressure to cylinder 42 is released, the springs 35 will draw the carriage 14 forwardly until the support 39 contacts the pad 38 on the undercarriage 22, in which position the tension on the core wire will have been released. Movement of the carriage relative to the undercarriage need not be great; it has been found that movement of from about two to five cm. is sufficient to tension the core wire.

Upon tensioning of core wire 10 in the manner just described, the core wire is rotated by the motors 8 and 17, which are operated in unison. The motors will preferably comprise identical reversible stepping motors, which are driven electronically with pulses such that each motor shaft will rotate through a predetermined angular displacement once per pulse, with the number of pulses per second determining the rotational speed of the motors. In accordance with the invention, identical repeated pulses are applied to each motor so that both motor shafts will rotate in synchronism through identical angles, thereby preventing the core wire from being twisted as it is rotated. The motor coils will be connected so that the direction of rotation of motor 17 will be opposite to that of motor 8, which is necessary inasmuch as the motor drive shafts face each other.

Electronic drive units 46 and 47 for the opposing drive motors are mounted beneath the opposite ends of the track member 1, the unit 46 being a slave unit controlled from unit 47, which comprises the master unit. The electric drive units are of known construction and are electronically interconnected for joint operation, the master unit 47 being provided with a calibrated speed control 48 which can be set to rotate the core wire in accordance with the size of wrapping wire being used and with the desired wrapping speed. The stepping motors can start and stop almost instantaneously in that they have relatively low internal inertia and a load (the core wire) which has negligible inertia. In practice, the stepping motors will come to rest from full speed within about two revolutions of the core wire.

An electronic counter 49, which is of known construction, is mounted on the machine frame and is programmed to count the convolutions of wrapping wire applied to the core wire and to turn off the machine after any predetermined number of convolutions has been applied to the core wire. Since one convolution of wrapping wire will be applied for each revolution of the core wire, the electronic pickup 13 associated with motor drive shaft 11 indicates to the counter the number of convolutions of wrapping wire applied to the core wire. The approximate number of convolutions required for a given string is determined by dividing the desired overall length of the wrap portion of the core wire by the diameter of the wrapping wire and the counter set accordingly. Once the counter has been correctly set, each string will have the same exact number of convolutions of wrapping wire, and the number of convolutions can be changed simply by resetting the counter. When a string is completed the counter can be reset to zero either manually or automatically so that it is ready to count the convolutions of the next string. Preferably, the counter will include a digital read-out window so that the actual number of convolutions on the string will be continuously displayed as the wrapping operation progresses.

As seen in FIGS. 1 and 2, a platform 50 is mounted at the right-end of the track member 1, the platform supporting bearing assemblies 51 and 52 which rotatably journal a spindle 53 on which a spool 54 of wrapping wire is placed. A frictional locking means 55 is provided on the end of the spindle so that the spool 54 cannot rotate on the spindle in normal use. In order to prevent the wrapping wire from spilling off the spool and to permit proper feeding of the wrapping wire, a brake 56 is mechanically coupled to the spindle 53 means of a toothed timing belt 57. The brake 56, which is a commercially available permanent magnet-type, permits the spindle to turn at any desired speed with a near-constant restraining torque of a value which is adjustable over a wide range to match the requirements for wrapping wire of various diameters used in making piano strings. It should be pointed out, however, that the spool brake 56 does not determine the amount of tension on the wrapping wire; rather, wrapping wire tension is controlled by means to be described hereinafter. The platform 50 also supports a frame assembly 58 on which is mounted a wrapping wire feed motor 59 which is operatively connected to a feed pulley 60 about which the core wire 61 passes for subsequent travel about a pulley 62 of like diameter which is rotatably attached to the end of the swing or dancer arm 63 which is pivotally mounted frame 58 by bracket member 64. Thereafter the wrapping wire 61 passes around a guide pulley 65 also mounted on the frame assembly 58. The feed motor 59 is a variable speed motor which, as will be explained hereinafter, is controlled by a potentiometer connected to the swing arm 63 as to control the rate at which wrapping wire is withdrawn from the spool 54.

The swing arm 63 is the principal tension-determining device for the wrapping wire. The arm is counterbalanced by an adjustable weight 66 mounted on the end of the arm opposite the pulley 62, and the stretching force or tension on the wrapping wire after it is threaded around the pulley 62 and 65 is established by loading the swing arm pulley with weights of known value. Thus, the swing arm 63 is loaded by means of selected weights 67 placed on a holder 68 operatively connected by cable 69 to the pulley-carrying end of swing arm 63, the cable passing upwardly to he swing arm around guide pulleys 70 and 71, seen in FIG. 2. When a weight of a particular value is placed on the holder 68, the pull on the wrapping wire 61 will be effectively one-half of the weight added to the swing arm pulley so long as the swing arm does not deviate drastically from an essentially horizontal position during operation.

As the wrapping wire 61 is withdrawn from the pulley 65, the swing arm 63 tends to rise slowly, depending upon the rate at which the wrapping wire is being used. In order to maintain the swing in an essentially horizontal position irrespective of variations in the rate at which the wrapping wire is being used, a potentiometer 72 is operatively connected to the shaft 73 of the swing arm, and the potentiometer is also operatively connected to the feed motor 59 and controls the rotational speed of the motor. The arrangement is such that increasing counterclockwise or upward movement of the swing arm 63 speeds-up the feed motor, thereby feeding the wrapping wire to the swing arm at a faster rate and hence acting to maintain the angular position of the swing arm in an essentially horizontal position which, in turn, maintains the wrapping wire under essentially constant tension. Conversely, if there is a decrease in the rate at which the wrapping wire is being used, the swing arm will tend to move in a clockwise or downward direction and, in so doing, the potentiometer will decrease the speed of rotation of feed motor 59 and hence return the feed arm to its equilibrium position. The feed pulley 60 is preferably provided with a rubber surface so that any difference between the restraining torque provided by the spool brake 56 and the pull of the swing arm will not cause the wrapping wire to slip relative to the surface of the feed pulley. It is also preferred to provide means for stopping the device in the event the contents of reel 54 is exhausted or should the wrapping wire break. To this end, adjustable limit switch 74 may be positioned to be contacted by the swing arm 63 should it fall below a predetermined level, the limit switch acting to cut-off power to the various operating components of the apparatus. Instrumentation, indicated at 75, may be provided to indicate feeding speed of the wrapping wire, such instrumentation being operatively connected to the feed pulley 60.

From the wrapping wire feeding and tensioning means just described, the wrapping wire extends lengthwise of the device to a feed arm assembly, indicated generally at 76, by means of which the wrapping wire 61 is fed into contact with the core wire 10. To this end, the feed arm assembly 76 is suspended from an overhead carriage 77 movable axially along a conveyor track 78 extending between supporting frame members 79 and 80 projecting upwardly from transverse beams 2 and 3, respectively. The carriage 77 is moved along the conveyor track 78 by means of an endless conveyor chain 81 which passes around sprockets 82 and 83 mounted on extensions 84 and 85 of the upper frame members 79 and 80. The conveyor chain 81 is driven by drive chain 86 operatively connected to a variable speed reversible drive motor 87 mounted on frame member 79.

Figure 6:
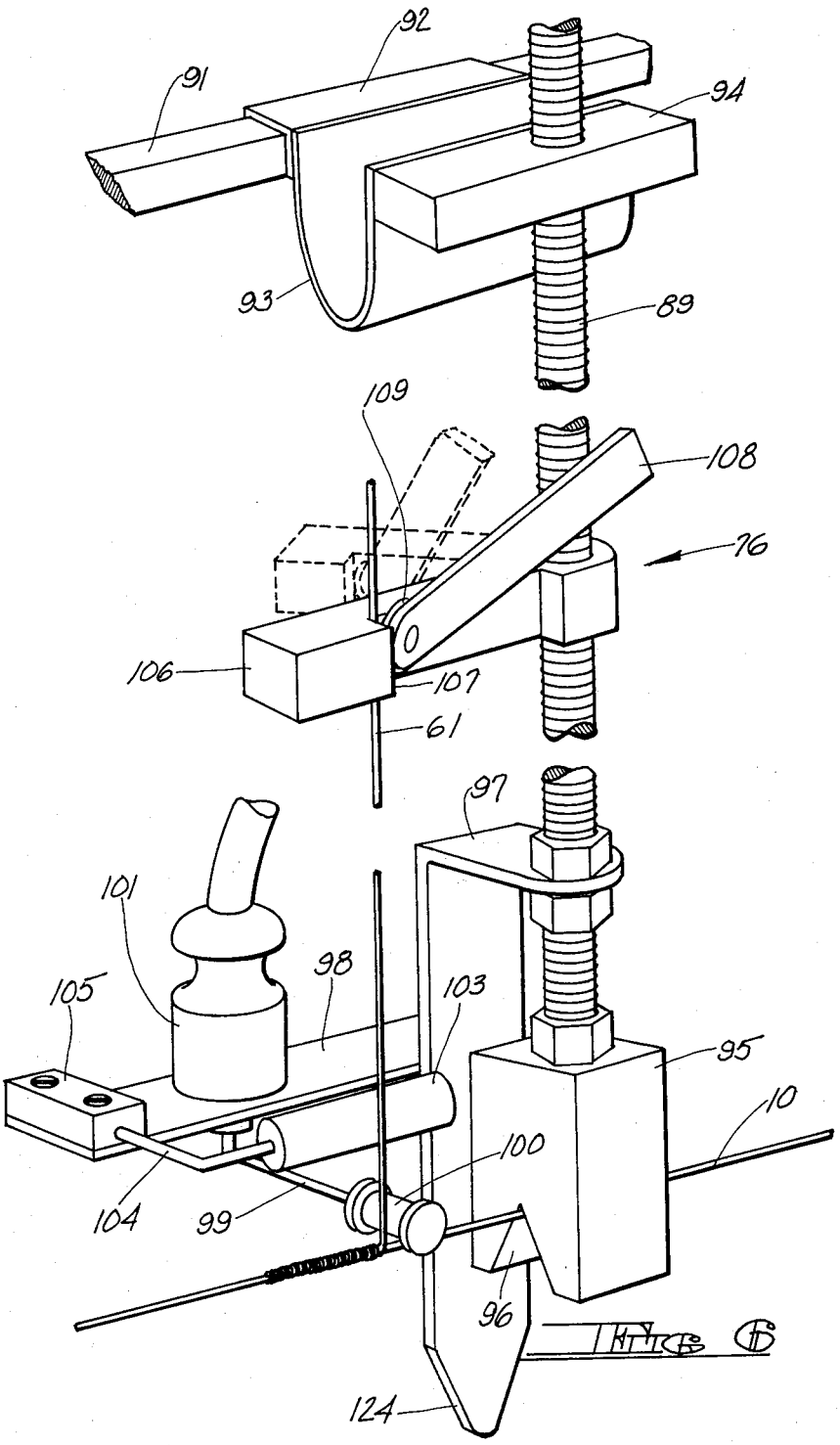
FIG. 6 is an enlarged exploded view of the wrapping wire feed arm and associated components.

The carriage 77 mounts a feed arm pulley 88 about which the wrapping wire 61 passes as it travels downwardly to the core wire 10. The feed arm itself, indicated at 89, is adjustably attached to a bracket 90 forming a part of the carriage 77, the feed arm being adjustable lengthwise of bracket 90 relative to the axis of the feed arm pulley 88 to thereby adjust the feed angle between the wrapping wire and the core wire. In order to damp undesirable oscillations of the feed arm, a rectangular rail 91 extends between the frame members 79 and 80 in parallel relation to the underlying track member 1. As best seen in FIG. 6, a bearing member 92 encircles the rail 91 and is free to move longitudinally along the rail. One leg of a U-shaped piece of damping material 93 is attached to the bearing 92, with the opposite leg of the damping material attached to feed arm 89 by means of a mounting member 94. The damping material will be flexible yet sufficiently rigid to maintain its U-shape, and its thickness will be selected to provide sufficient damping so that the feed arm will not vibrate.

At its lowermost end the feed arm 89 mounts a saddle member 95 having a V-groove 96 in its undersurface into which the core wire 10 fits, the saddle serving to restrain the core wire so that it is not deflected significantly from its straight line axis by the pull of the wrapping wire during the wrapping operation. Preferably, the saddle 95 will be formed from a long-wearing plastic material, such as Nylon or Delrin, and the saddle will be vertically adjustable on the feed arm 89 so that it will make firm yet non-deflecting contact with the core wire. The feed arm also mounts a bracket 97 having an extension 98 to which a servo arm 99 is pivotally connected, the servo arm having a small plastic wheel 100 at its outermost end which is adapted to ride against the wrapping wire 61 near its point of contact with core wire 10. The opposite end of the servo arm is attached to a precision potentiometer 101 operatively connected to the variable speed motor 87 which drives the carriage on which the feed arm is mounted. With this arrangement, the angular position of the servo arm 99, which is biased into contact with the wrapping wire 61 by means of spring 102 (seen in FIG. 2), determines the speed of travel of the carriage 77 and feed arm 89. With this arrangement, a constant feed angle can be maintained between the core wire and the wrapping wire. In this connection, it will be understood that in normal operation the wrapping wire 61 extends directly directly between the feed arm pulley 88 and the core wire 10. As previously indicated, the desired angle between the wrapping wire and the core wire is initially established by adjusting the location of feed arm 89 relative to the axis of feed arm pulley 88. Once the desired angle has been established, any change in that angle will be sensed by the servo arm 99 which will either speed-up or slow-down the rate of travel of carriage 77. For example, if the carriage 77 is traveling faster than the rate at which convolutions of wrapping wire are being formed on the wire, the servo arm 99, which travels with the feed arm, 89, will rotate in a clockwise direction, as viewed in FIG. 6, since the spring 102 maintains it in contact with the wrapping wire 61. Movement of the servo arm in a clockwise direction will reduce the speed of motor 87 and hence slow-down the rate of travel of carriage 77. Conversely, if the carriage is traveling too slowly, the convolutions of wrapping wire being builtup on the core wire will reduce the distance between the wrapping wire 61 and the feed arm 89, thereby urging the servo arm 99 in a counterclockwise direction against the tension of its spring 102, such movement serving to increase the speed of motor 87 and hence the rate of travel of the carriage 77.

The feed arm assembly also may include a plastic roller 103 rotatably mounted on an arm 104 adjustably secured by mounting block 105 to the extension 98 of bracket 97. The function of the roller is to restrict the spiraling angle of the wrapping wire in order to prevent the wrapping wire from folding back over itself and making a double layer of convolutions. The roller 103 is normally adjusted to lie directly over the core wire and several inches above it. The roller will be adjusted to have a rake angle which will assist in maintaining the feed angle of the wrapping wire at a value determined by the relation between the feed arm pulley 88 relative to the position of the wrapping wire on the core wire. By rake angle is meant a slight angular deviation of the axis of the roller from parallelism with the core wire axis.

At the completion of the wrapping operation the end of the wrapping wire must be broken or cut, and provision is made to clamp the freed end of the wrapping wire to the feed arm so that it will be readily available when the feed arm is returned toward the opposite end of the apparatus for starting another string. To this end, the feed arm also mounts a pivotable clamping block 106 having a wire engaging shoulder 107 against which the wrapping wire is adapted to seat when the clamping block is pivoted from the position shown in dotted lines in FIG. 6 to the position shown in solid lines. It will be understood that the clamping block normally will be free from engagement with the wrapping wire 61 during the wrapping operation and will be swung into engagement with the wrapping wire at the completion of the wrapping operation but prior to the severing of the wrapping wire. The wrapping wire is clamped against the shoulder 107 by means of clamping arm 108 having an eccentrically mounted clamping wheel 109 positioned to contact the wire. The eccentric mounting of the wheel 109 provides a wedging action of the wheel against the wire which securely holds the wire in place.

In the wrapping operation, it is essential that both the leading and trailing ends of the wrapping wire are securely fastened to the core wire. This is customarily accomplished by flattening the core wire for a short distance, usually about two to four cm. at each end of the portion of the wire to be wrapped, so that the ends of the wrapping wire may be anchored, normally by swaging against the flats; thus the ends of the wrapping wire cannot turn relative to the core wire. In order to accomplish the flattening of the core wire, and as seen in FIGS. 1 and 2, the track member 1 is provided with a pair of anvil carriages 110 and 111 which are adjustably movable along the track member intermediate the fixed head 7 and the movable carriage 14. These carriages, which are of a construction somewhat similar to the undercarriage 22, are provided with friction brakes 112 and 113 by means of which the anvil carriages may be clamped to the track member at any desired location. The carriages mount retractable anvils 114 and 115 which are slidably mounted on transverse guide ways 116 and 117, respectively, the anvils being movable from the retracted position illustrated in FIG. 2 to an extended position in which they underlie the core wire. The anvil carriages may be clamped in the desired locations, depending upon the length of the core wire to be wrapped, utilizing the calibrated measuring rule 40 to locate the anvils at the desired positions. Once a core wire has been attached and tensioned, the anvils 114 and 115 will be moved forwardly to underlie and support the core wire, whereupon the flats may be formed by striking the core wire with a hammer or similar tool in the area supported on the anvils. Thereafter the anvils are retracted and the feed arm assembly brought into a position to permit the manual wrapping of several convolutions of the wrapping wire around the flat formed over the anvil 114. The wrapping wire will, of course, be wound around the flat formed over anvil 115 when the feed arm assembly reaches that position.

In order to further insure against vibration of the core wire during the wrapping operation, the opposite ends of the core wire may be damped by pads 118 and 119 composed of brush-like plastic bristles, the pad 118 being mounted on a support 120 projecting from the carriage 14, and the pad 119 on a support 121 projecting from anvil carriage 111. Thus, the core wire is damped adjacent the point of wrapping by the saddle 95 and toward its opposite ends by the pads 118 and 119.

The apparatus also may be provided with various switch means to control the operation of various components. For example, a limit-switch 122 having a flexible contact arm 123 may be mounted on the anvil carriage 110, the switch being positioned to be contacted by the lowermost end of bracket 97 on the mounting head, which projects downwardly below the core wire to define a depending finger 124. A similar switch 125 may be mounted on the anvil carriage 111 with its flexible contact arm 126 positioned to be contacted by the depending finger 124 when the feed arm assembly passes over anvil 115, thereby arresting movement of the feed arm assembly as it passes over the anvil. This switch may be utilized in place of the counter 49 if it is desired to wrap a predetermined length of the core wire, the calibrated measuring rule 40 being utilized to position anvil carriage 111 so that switch 125 will be actuated when the desired length of core wire has been wrapped. Alternatively, switch 125 may serve as a part of the feed arm carriage return system. That is, after a string has been wrapped and removed from the machine the operator will press a switch, such as the return switch 127 on control panel 128, to energize feed arm carriage drive motor 87 and cause the feed arm carriage to travel in the opposite direction, thereby moving the feed arm toward anvil 114, which is the starting position for wrapping a new core wire. The carriage will be automatically stopped when depending finger 124 contacts arm 123 of switch 122 mounted on anvil carriage 110. However, to avoid the possibility that the return switch 127 might be accidentally pressed with damaging results when the feed arm is near the opposite end of the machine, the switch 125 may be used as a safety switch to lock-out the circuit to drive motor 87 through return switch 127 unless depending finger 124 is in contact with arm 126 of switch 125. Of course, two separate switches could be mounted on anvil carriage 111, one serving as a stop switch for the feed carriage and the other as a safety switch, or the switch 125 may comprise a multiple contact switch capable of performing both functions.

It is also preferred to provide readily accessible manual control switches to permit independent left or right movement of the feed arm assembly. Thus, a pair of switches 129 and 130 may be mounted on anvil carriage 110, the switch 129 providing for movement of the feed arm assembly in one direction, with switch 130 serving to move the feed arm assembly in the opposite direction. These switches are particularly useful in obtaining fine adjustment of the feed arm relative to the flat on the core wire at which wrapping is to be initiated.

Safety switches also may be provided to prevent damage to the apparatus in the event of malfunctions. For example, limit switches 131 and 132 may be suspended from conveyor track 78 to de-energize motor 87 in the event they are contacted by feed arm carriage 77, thereby preventing the feed arm assembly from overrunning carriage 14 at one end and fixed head 7 at the other. Similarly, a limit switch 133 may be mounted on frame 58 in a position to be contacted by swing arm 63 in the event an obstruction prevents the wrapping wire from being freely removed from spool 54 or if an unexpected abnormality is encountered between wrapping wire feeding speed and wrapping wire demand, as might by occasioned by the malfunction of feed motor 59.

As should now be apparent, the instant invention provides an essentially automatic string wrapping apparatus in which the various factors which influence the quality of the wrapped strings can be carefully and uniformly controlled. In addition to providing single wrapped strings, the apparatus also may be utilized to wind double wrapped strings. In double wrapped strings it is customary for the inner and outer windings to have their helices running in opposite directions. With prior art machines in which the core wire could be rotated in only one direction, double wrapping was accomplished by starting the inner and outer windings at opposite ends of the core wire, i.e., the inner winding might be from left to right, followed by the outer windings from right to left. With the present apparatus, both the inner and outer windings may be started at the same end of the core wire by the simple expedient of reversing the direction of rotation of the core wire and applying the inner and outer windings to opposite sides of the core wire. This may be readily accomplished since the stepping motors are preferably of the reversible type.

It will be understood, of course, that numerous modifications may be made in the invention without departing from its spirit and purpose. A number of such modifications have already been set forth and others will undoubtedly occur to the worker in the art upon reading this specification. By way of non-limiting examples, the anvils mounted on the anvil carriages may be mechanically extended and retracted, as by means of pnuematic cylinders or solenoids, and pneumatic hammers could be integrally associated with the anvils to form the flats in the core wire instead of performing this operation by hand. Similarly, the wrapping wire tension could be obtained by using a low friction pneumatic cylinder instead of weights to load the swing arm. Such arrangement would reduce swing arm inertia and permit the loading of the swing arm to be adjusted by means of a pressure regulator, thereby eliminating the necessity for selecting and applying weights of the required magnitude to load the swing arm. It also may be found advantageous to reverse the positions of the fixed and movable heads, placing the movable head on the right end of the machine rather than on the left. Such reversal has the advantage of enabling the operator to commence the wrapping operation in close proximity to the looped end of the core wire. Other modifications will undoubtedly occur to the worker in the art, and it is not intended that the invention be limited other than in the manner set forth in the claims which follow.

The embodiments of the invention in which an exclusive property or privilege is claimed are defined as follows:

1. In apparatus for applying a wrapping wire to a core wire, an elongated track member, a first head mounted toward one end of said track member, a second head mounted for movement lengthwise of said track member toward and away from said first head, means for releasably securing said second head in predetermined fixed position relative to said first head, a shaft rotatably journaled in each of said heads, said shafts facing each other and being in axial alignment, means for rotating said shafts in unison, means on said shafts for connecting the opposite ends of a core wire thereto, means associated with one of said heads for placing the core wire under tension, means for feeding a wrapping wire into contact with the core wire, adjustable means for establishing a predetermined approach angle at which the wrapping wire is fed into contact with the core wire, means for advancing said wrapping wire feeding means lengthwise of said track in timed relation to the formation of convolutions of wrapping wire around the core wire as the latter is rotated, means for applying a predetermined uniform tension to the wrapping wire as it is fed into contact with the core wire, and control means for rotating said shafts through a desired number of revolutions to form a like number of convolutions of wrapping wire on the core wire.

2. The apparatus claimed in claim 1 wherein the means for rotating said shafts in unison comprise stepping motors connected to said shafts, and electronic drive units for said motors, said electronic drive units being synchronized to operate said motors in unison.

3. The apparatus claimed in claim 2 wherein the control means for rotating said shafts through a desired number of revolutions comprises an electronic counter operatively connected to the electronic drive units for said motors, said counter being capable of being preset to count a selected number of revolutions of said shafts, said counter having an electronic pick-up associated with one of said shafts for pulsing the counter for each revolution of said shafts.

4. The apparatus claimed in claim 2 wherein said control means for rotating said shafts through a desired number of revolutions comprises an electronic counter operatively connected to the electronic drive units for said motors, said counter including switch means operative to deenergize said motors upon completion of a predetermined number of revolutions of said shafts.

5. The apparatus claimed in claim 2 wherein said control means for rotating said shafts through a desired number of revolutions comprise switch means positioned to be contacted by the means for feeding the wrapping wire into contact with the core wire upon completion of the desired number of revolutions of the shafts, contact of the switch means by said wrapping wire feeding means serving to deenergize said motors.

6. The apparatus claimed in claim 1 wherein said second head is mounted on a carriage movable lengthwise along said track member, an undercarriage movable lengthwise along said track member and underlying said carriage, spring means interconnecting said carriage and undercarriage, said spring means biasing said carriage into engagement with said undercarriage, and wherein the means for releasably securing said second head in predetermined fixed position on said track member comprises clamping means on said undercarriage releasably engageable with said track member, whereby said undercarriage provides a fixed stop for said carriage when said clamping means is in engagement with the said track means.

7. The apparatus claimed in claim 6 wherein the means associated with one of said heads for placing the core wire under tension comprises means for displacing said carriage rearwardly along said track member relative to said undercarriage against the resistance of said spring means.

8. The apparatus claimed in claim 7 wherein the means for displacing said carriage rearwardly relative to said undercarriage comprises a pneumatic cylinder mounted on said carriage, said cylinder having a piston rod engagable with said undercarriage, said piston rod, when extended, acting to displace said carriage rearwardly relative to said undercarriage.

9. The apparatus claimed in claim 1 wherein the means for feeding a wrapping wire into contact with the core wire comprises a vertically disposed feed arm having a core wire engaging saddle at its lowermost end.

10. The apparatus claimed in claim 9 wherein said saddle is formed from plastic and has V-groove in its undermost surface in which the core wire is seated.

11. The apparatus claimed in claim 9 wherein the means for advancing the wrapping wire feeding means lengthwise of said track member comprises a feed arm carriage overlying said track member, said feed arm carriage being movably mounted on a conveyor track extending lengthwise of said track member and spaced upwardly therefrom, and drive means operatively connected to said feed arm carriage for moving it along said conveyor track, the upper end of said feed arm being attached to said feed arm carriage.

12. The apparatus claimed in claim 9 wherein said feed arm carriage mounts a feed arm pulley for the wrapping wire, the wrapping wire being adapted to extend downwardly from said feed arm pulley for engagement with the core wire.

13. The apparatus claimed in claim 12 wherein the adjustment means for establishing a predetermined approach angle for the wrapping wires comprises means adjustably mounting said feed arm to said feed arm carriage for movement of said feed arm relative to said carriage in a direction lengthwise of said track member.

14. The apparatus claimed in claim 11 wherein a spring biased servo arm is pivotally mounted on said feed arm adjacent its lowermost end and positioned to be urged into contact with the wrapping wire in close proximity to its point of engagement with the core wire, a potentiometer operatively connected to said servo arm and to the drive means for said feed arm carriage, said last named drive means comprising a variable speed motor.

15. The apparatus claimed in claim 11 wherein an adjustable roller is mounted on said feed arm adjacent its lowermost end and positioned to contact the wrapping wire a short distance above the core wire, the axis of said roller generally paralleling the axis of the core wire but being adjustable in a horizontal plane.

16. The apparatus claimed in claim 11 including a wrapping wire clamping means mounted on said feed arm.

17. The apparatus claimed in claim 16 wherein said feed arm clamping means is movable from an inoperative position to an operative position in which it engages the wrapping wire.

18. The apparatus claimed in claim 11 including vibration damping means operatively connected to said feed arm intermediate its opposite ends.

19. The apparatus claimed in claim 18 wherein said feed arm damping means comprises a guide track overlying and extending lengthwise of said track member in close lateral proximity to said feed arm, a bearing member slidable along said guide track, and a U-shaped piece of damping material having one leg attached to said bearing member and the other leg attached to said feed arm.

20. The apparatus claimed in claim 11 including a depending finger on said feed arm displaced laterally from and extending below said feed arm saddle, and switch means mounted on said track member in position to be contacted by said finger as said feed arm traverses said track member.

21. The apparatus claimed in claim 1 wherein the means for applying a predetermined tension to the wrapping wire comprises a feed pulley for withdrawing wrapping wire from a source of supply, a variable speed feed motor operatively connected to said feed pulley, a swing arm mounting a swing arm pulley at one end about which the wrapping wire passes from the feed pulley, and a guide pulley about which the wrapping wire passes from said swing arm pulley, said swing arm pulley lying intermediate and beneath said feed and guide pulleys, and means for loading said swing arm to exert tension on the wrapping wire.

22. The apparatus claimed in claim 21 wherein the means for loading said swing arm comprises a weight holder suspended from said swing arm to receive and support weights or predetermined magnitude.

23. The apparatus claimed in claim 22 wherein an adjustable counterbalancing weight is connected to the opposite end of said swing arm.

24. The apparatus claimed in claim 21 wherein said swing arm is mounted on a pivot shaft, a potentiometer connected to said pivot shaft, said potentiometer being operatively connected to the variable speed feed motor for said feed pulley.

25. The apparatus claimed in claim 24 wherein said feed pulley is lined with a friction material to prevent slippage of the wrapping wire relative to the feed pulley.

26. The apparatus claimed in claim 1 wherein a pair of anvil carriages is adjustably mounted on said track member between said heads, each said anvil carriage mounting an anvil movable from a retracted position to an extended position in which the anvils underlie and are contacted by the core wire.

27. The apparatus claimed in claim 26 including clamping means on said anvil carriages for securing them to said track member.

28. The apparatus claimed in claim 27 including damping means mounted on one of said anvil carriages and positioned to contact the core wire.

29. The apparatus claimed in claim 28 wherein said damping means comprises a pad of bristles.

30. The apparatus claimed in claim 1 including damping means positioned to contact the core wire in the areas lying outwardly of the portion of the core wire being wrapped.

31. The apparatus claimed in claim 30 wherein said damping means comprises pads of plastic bristles.

32. The apparatus claimed in claim 31 wherein said damping means are mounted on carriages movable lengthwise along said track member.

33. The apparatus claimed in claim 1 including a calibrated measuring rule extending lengthwise along the upper surface of said track member, carriage means mounting said second head for movement along said track member, and means for clamping said carriage means to said track member in predetermined locations indicated by said calibrated measuring rule.

34. The apparatus claimed in claim 33 including a pair of anvil carriages mounted for movement along said track member intermediate said heads, clamping means for securing said anvil carrying carriages to said track member in predetermined locations indicated by said calibrated measuring rule.

35. The apparatus claimed in claim 1 wherein the means for advancing said wrapping wire feeding means lengthwise of said track comprises a servo controlled variable speed drive means.

36. The apparatus claimed in claim 35 wherein said servo controlled variable speed drive means comprises a variable speed reversible motor operatively connected to a servo mechanism having a sensor positioned to contact the wrapping wire as it approaches the core wire.

37. The apparatus claimed in claim 1 including means operatively connected to the means for advancing said wrapping wire feed means for maintaining the predetermined approach angle of the wrapping wire constant as said feed means is advanced lengthwise of said track.

* * * * *